US010017889B2

(12) United States Patent
Kongo

(10) Patent No.: US 10,017,889 B2
(45) Date of Patent: Jul. 10, 2018

(54) EMBROIDERY DESIGN CONNECTING DATA GENERATING APPARATUS, EMBROIDERY DESIGN CONNECTING DATA GENERATING METHOD, RECORDING MEDIUM FOR STORING PROGRAM, AND SEWING SYSTEM

(71) Applicant: Janome Sewing Machine Co., Ltd., Tokyo (JP)

(72) Inventor: Takeshi Kongo, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 15/442,736

(22) Filed: Feb. 27, 2017

(65) Prior Publication Data

US 2017/0306542 A1 Oct. 26, 2017

(30) Foreign Application Priority Data

Apr. 26, 2016 (JP) ..... 2016-088485

(51) Int. Cl.
*D05C 5/02* (2006.01)
*D05B 19/08* (2006.01)

(52) U.S. Cl.
CPC ..... *D05B 19/08* (2013.01)

(58) Field of Classification Search
CPC ..... D05B 19/00; D05B 19/02; D05B 19/04; D05B 19/08; D05B 19/10; D05C 5/00; D05C 5/02
USPC ..... 700/136–138
See application file for complete search history.

(56) References Cited

U.S. PATENT DOCUMENTS 4,998,489 A * 3/1991 Hisatake ..... D05B 19/08 112/103
5,323,722 A * 6/1994 Goto ..... G05B 19/4205 112/102.5
5,911,182 A * 6/1999 Uyama ..... D05B 19/085 112/102.5
6,263,815 B1 * 7/2001 Furudate ..... D05B 7/00 112/470.13
6,994,042 B2 * 2/2006 Schweizer ..... D05B 19/16 112/470.03

(Continued)

FOREIGN PATENT DOCUMENTS

JP 5687746 B2 3/2015

*Primary Examiner* — Nathan Durham
(74) *Attorney, Agent, or Firm* — Nakanishi IP Associates, LLC

(57) ABSTRACT

With an embroidery design connecting data generating apparatus, an image acquisition unit acquires an image of an embroidery frame mounting a cloth having a portion where an embroidery design has been sewn. A display unit displays the image of the cloth having such an embroidery-sewn portion acquired by the image acquisition unit and an image of an embroidery design to be sewn to the cloth. An embroidery design data editing unit edits the embroidery design image such that it is connected with the already-sewn embroidery design in a state in which the image of the cloth having the embroidery-sewn portion is displayed on the display unit. Such an arrangement prevents the occurrence of overlapping or gaps after embroidery designs are sewn even if accumulated shrinkage occurs in the sewing operation, or slight alignment errors occur in position or rotation when the cloth is mounted on the embroidery frame.

14 Claims, 14 Drawing Sheets

(56) References Cited

U.S. PATENT DOCUMENTS

| | | | | |
|---|---|---|---|---|
| 7,392,755 | B2 * | 7/2008 | Kato | D05B 19/12 112/102.5 |
| 8,061,286 | B2 * | 11/2011 | Hirata | D05C 5/04 112/102.5 |
| 8,074,590 | B2 * | 12/2011 | Bentley | D05B 11/00 112/470.01 |
| 8,763,541 | B2 * | 7/2014 | Tokura | D05C 5/06 112/102.5 |
| 9,127,383 | B2 * | 9/2015 | Yamanashi | D05C 5/02 |
| 9,228,279 | B2 * | 1/2016 | Abe | D05B 19/08 |
| 2014/0083345 | A1 * | 3/2014 | Tokura | D05B 19/08 112/470.01 |
| 2015/0345056 | A1 * | 12/2015 | Imaizumi | D05B 19/08 700/138 |

* cited by examiner

EMBROIDERY DESIGN CONNECTING DATA GENERATING APPARATUS, EMBROIDERY DESIGN CONNECTING DATA GENERATING METHOD, RECORDING MEDIUM FOR STORING PROGRAM, AND SEWING SYSTEM

CROSS REFERENCE TO RELATED APPLICATIONS

This application is based on and claims the benefit of priority to Japanese Patent Application No. 2016-088485 filed on Apr. 26, 2016, the contents of which are hereby incorporated by reference in their entirety.

BACKGROUND OF INVENTION

Field of the Invention

The present invention relates to an embroidery design connecting data generating apparatus, an embroidery design connecting data generating method, a recording medium for storing a program, and a sewing system.

Description of the Related Art

A stippling design is a single complicated curved pattern obtained by drawing a single curved line, which is mainly employed in quilting sewing. Typically, such a stippling design is formed manually, i.e., in a so-called free motion method.

However, such a free motion method requires a skilled operator. Otherwise, it is difficult to sew such a stippling design. In particular, it is almost impossible for an ordinary sewing machine user to operate a sewing machine to sew such a stippling design to a large quilt cloth.

In order to address such an issue, a method has been provided in which sewing of such a stippling design is performed by means of an embroidery sewing machine. However, in a case of a large embroidery design, such an arrangement cannot sew such a large design at one time. That is to say, such an arrangement requires the user to perform a sewing operation multiple times and to shift the mounting position of a sewing target such as a cloth every time one sewing operation ends. In a case of employing such a method in which sewing of an embroidery design is performed multiple times so as to provide a large embroidery design, such a method leads to issues. Examples of such issues include: an issue of overlapping between adjacent embroidery designs; and an issue of the occurrence of gaps between adjacent embroidery designs. Accordingly, it is difficult for such a method to provide a single embroidery design having high uniformity over its entire area.

In order to address such an issue, a technique has been known as disclosed in Patent document 1. That is to say, such an arrangement employs a rectangular embroidery coverage region having a pair of upper and lower sides that are opposite to each other and a pair of left and right sides that are opposite to each other. Furthermore, the stitch data of a stippling design is arranged in the rectangular embroidery coverage region such that one side is assigned to a protruding pattern of the stippling design and the side opposite to the one side is assigned to a recessed pattern of the stippling design. With such a rectangular embroidery coverage region, sewing is performed multiple times such that one side of the rectangular embroidery coverage region in the current sewing is aligned with the opposite side in the immediately previous sewing. Such an arrangement is capable of providing a single large stippling design with high uniformity over its entire area without an issue of the generation of a sense of incongruity due to overlapping between adjacent embroidery designs or the occurrence of gaps between them.

RELATED ART DOCUMENTS

Patent Documents

[Patent Document 1]

Japanese Patent No. 5,687,746

However, with such a method described in Patent document 1, in the sewing operation, such an arrangement has the potential to have an issue of the occurrence of overlapping or gaps between adjacent embroidery designs due to accumulated shrinkage that occurs in the sewing operation, slight alignment errors in position or rotation that occur when a cloth is mounted on an embroidery frame, or the like.

SUMMARY OF THE INVENTION

The present invention has been made in order to address such an issue. Accordingly, it is a purpose of the present invention to provide an embroidery design connecting data generating apparatus, an embroidery design connecting data generating method, a recording medium for storing a program, and a sewing system, configured to prevent the occurrence of overlapping and gaps between adjacent embroidery designs when such sewing is performed multiple times for an embroidery design even if accumulated shrinkage occurs in the sewing operation, or even if slight alignment errors occur in position or rotation when a cloth is mounted on an embroidery frame, or the like.

Embodiment (1)

One or more embodiments of the invention provide an embroidery design connecting data generating apparatus. The embroidery design connecting data generating apparatus comprises: an image acquisition unit that acquires an image of an embroidery design that has been provided by sewing to a portion of a cloth; a display unit that displays the image of the embroidery design that has been provided by sewing to the portion of the cloth after it is acquired by the image acquisition unit, and an image of an embroidery design to be sewn to the cloth; and an embroidery design image editing unit that edits the image of the embroidery design to be sewn to the cloth, such that it is connected with the image of the embroidery design that has been provided by sewing to the portion of the cloth in a state in which they are displayed on the display unit.

Embodiment (2)

One or more embodiments of the invention also provide the embroidery design connecting data generating apparatus. The image acquisition unit acquires an image of an embroidery frame mounting the cloth. The embroidery design connecting data generating apparatus comprises: an embroidery frame information acquisition unit that acquires information with respect to the embroidery frame; and an acquired image analyzing unit that performs image analysis so as to acquire a correspondence between the information with respect to the embroidery frame acquired by the embroidery frame information acquisition unit and information with respect to the image of the embroidery frame acquired by the image acquisition unit.

Embodiment (3)

One or more embodiments of the invention also provide the embroidery design connecting data generating apparatus. The embroidery design image is the same as the embroidery design that has been sewn to the portion of the cloth.

Embodiment (4)

One or more embodiments of the invention also provide the embroidery design connecting data generating apparatus. The embroidery design to be sewn to the cloth is the same as the embroidery design that has been sewn to the portion of the cloth.

Embodiment (5)

One or more embodiments of the invention also provide the embroidery design connecting data generating apparatus. The embroidery design connecting data generating apparatus comprises an embroidery design data editing unit that edits the data of the embroidery design generated by the embroidery design data generating unit, based on the image of the embroidery design edited by the embroidery design image editing unit before it is sewn to the portion of the cloth.

Embodiment (6)

One or more embodiments of the invention also provide the embroidery design connecting data generating apparatus. The embroidery design connecting data generating apparatus comprises an input operating unit that allows a user to input an operating instruction. The embroidery design image editing unit edits the image of the embroidery design to be sewn to the cloth, according to an operating instruction received via the input operating unit.

Embodiment (7)

One or more embodiments of the invention also provide the embroidery design connecting data generating apparatus. The embroidery design connecting data generating apparatus comprises a sewing execution number-of-times determination unit that determines a number of times that sewing of the embroidery design is to be performed for the cloth, based on the information with respect to the embroidery frame acquired by the embroidery frame information acquisition unit and information received via the input operating unit with respect to a region of the cloth to be subjected to the embroidery sewing.

Embodiment (8)

One or more embodiments of the invention also provide the embroidery design connecting data generating apparatus. The image acquisition unit performs image acquisition giving priority to a region of the cloth that is not adjacent to other regions thereof each having a portion to which the embroidery design has been sewn.

Embodiment (9)

One or more embodiments of the invention also provide the embroidery design connecting data generating apparatus. The embroidery design connecting data generating apparatus comprises an operation guidance unit that provides a user with at least one from among a guidance display and an audio guidance in the image acquisition operation of the image acquisition unit.

Embodiment (10)

One or more embodiments of the invention also provide the embroidery design connecting data generating apparatus. The embroidery design connecting data generating apparatus comprises a display control unit. The display control unit instructs the display unit to display a reference image of the embroidery frame based on the information with respect to the embroidery frame acquired by the embroidery frame information acquisition unit. The operation guidance unit performs the guidance so as to provide an alignment between the reference image of the embroidery frame displayed on the display unit and an acquired image of the embroidery frame displayed on the display unit via the image acquisition unit.

Embodiment (11)

One or more embodiments of the invention also provide the embroidery design connecting data generating apparatus. The reference image of the embroidery frame is displayed in a semi-transparent manner on the display unit.

Embodiment (12)

One or more embodiments of the invention also provide the embroidery design connecting data generating apparatus. When an alignment has been obtained between the reference image of the embroidery frame and the acquired image of the embroidery frame displayed on the display unit via the image acquisition unit, the image acquisition unit automatically performs image acquisition.

Embodiment (13)

One or more embodiments of the invention also provide the embroidery design connecting data generating apparatus. The embroidery design image editing unit shifts at least one from among a vertex or a side of a polygonal shape that corresponds to an outline of an image of the embroidery design, so as to modify the image of the embroidery design.

Embodiment (14)

One or more embodiments of the invention also provide an embroidery design connecting data generating method employed in an embroidery design connecting data generating apparatus. The embroidery design connecting data generating method comprises: acquiring, by an image acquisition unit included in the embroidery design connecting data generating apparatus, an image of an embroidery design that has been provided by sewing to a portion of a cloth; displaying, by a display unit included in the embroidery design connecting data generating apparatus, the image of the embroidery design that has been provided by sewing to the portion of the cloth after it is acquired by the image acquisition unit, and an image of an embroidery design to be sewn to the cloth; and editing, by an embroidery design image editing unit included in the embroidery design connecting data generating apparatus, the image of the embroidery design to be sewn to the cloth, such that it is connected with the image of the embroidery design that has been provided by sewing to the portion of the cloth in a state in which they are displayed on the display unit.

Embodiment (15)

One or more embodiments of the invention also provide a recording medium for storing a program configured to instruct an embroidery design connecting data generating apparatus to execute an embroidery design connecting data generating method. The embroidery design connecting data generating method comprises: acquiring, by an image acquisition unit included in the embroidery design connecting data generating apparatus, an image of an embroidery design that has been provided by sewing to a portion of a cloth; displaying, by a display unit included in the embroidery design connecting data generating apparatus, the image of the embroidery design that has been provided by sewing to the portion of the cloth after it is acquired by the image acquisition unit, and an image of an embroidery design to be sewn to the cloth; and editing, by an embroidery design image editing unit included in the embroidery design connecting data generating apparatus, the image of the embroidery design to be sewn to the cloth, such that it is connected with the image of the embroidery design that has been provided by sewing to the portion of the cloth in a state in which they are displayed on the display unit.

Embodiment (16)

One or more embodiments of the invention also provide a sewing system comprising an embroidery design connecting data generating apparatus and a sewing machine. The embroidery design connecting data generating apparatus comprises: an image acquisition unit that acquires an image of an embroidery design that has been provided by sewing to a portion of a cloth; a display unit that displays the image of the embroidery design that has been provided by sewing to the portion of the cloth after it is acquired by the image acquisition unit, and an image of an embroidery design to be sewn to the cloth; an embroidery design image editing unit that edits the image of the embroidery design to be sewn to the cloth, such that it is connected with the image of the embroidery design that has been provided by sewing to the portion of the cloth in a state in which they are displayed on the display unit; and a transmission unit that transmits, to the sewing machine, the image data of the embroidery design edited by the embroidery design image editing unit or otherwise embroidery design data edited based on the image of the embroidery design edited by the embroidery design image editing unit. The sewing machine comprises: a reception unit that receives, from the transmission unit, the image data of the embroidery design or otherwise the embroidery design data; and an embroidery executing unit that executes an embroidery operation for the cloth mounted on the embroidery frame according to the image data of the embroidery design or otherwise the embroidery design data received by the reception unit.

With at least one embodiment of the present invention, such an arrangement provides an advantage of preventing the occurrence of overlapping or gaps after multiple embroidery designs are sewn even if accumulated shrinkage occurs in the sewing operation, or slight alignment errors occur in position or rotation when the cloth is mounted on the embroidery frame.

DETAILED DESCRIPTION

Detailed description will be made below regarding an embodiment of the present invention with reference to the drawings.

Embodiment

Description will be made with reference to FIGS. 1 through 14 regarding a sewing system according to an embodiment.

[Configuration of the Sewing System]

Figure 1:
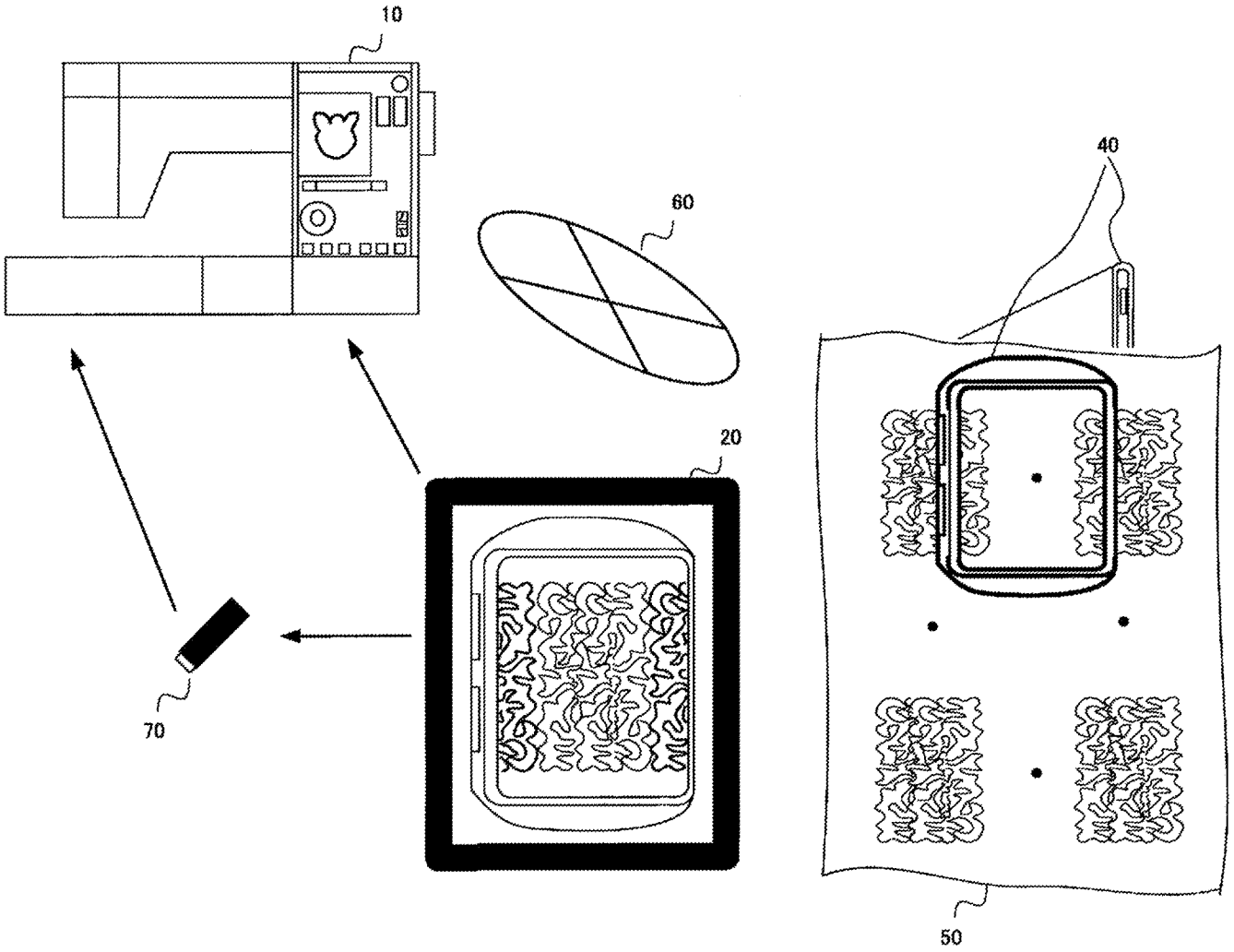
FIG. 1 is a diagram showing a schematic configuration of a sewing system according to an embodiment of the present invention.

As shown in FIG. 1, the sewing system according to the present embodiment is configured including a sewing machine 10 and a tablet terminal 20 configured as an embroidery design connecting data generating apparatus. The sewing machine 10 and the tablet terminal 20 are connected to each other via a network such as a wireless LAN 60 or the like.

It should be noted that the present embodiment is not restricted to such an arrangement employing such a network such as the wireless LAN 60 or the like. For example, a communication system may be employed using Bluetooth (trademark). Also, an off-line communication system may be employed using USB memory 70 or the like, for example.

With a sewing system according to the present embodiment, a cloth is stretched over an embroidery frame having a known size such that it covers a space area (gap area) between discontinuously sewn stippling designs, for example. Next, the user instructs an image acquisition unit of the tablet terminal 20 to acquire an image of the overall area of the embroidery frame 20. The image thus acquired is displayed on a display unit of the tablet terminal 20 together with a stitch image of an embroidery design. Furthermore, after the user adjusts the position of the stitch image, the image of the embroidery design is modified by means of calculation such that the stitch image thus modified fits the space area (gap area). Subsequently, embroidery sewing is performed for the cloth stretched over the embroidery frame based on the embroidery design image thus modified and received by the sewing machine 10. Such an arrangement provides a stippling design area fitted to the adjacent stippling designs without a gap or space between them.

Figure 2:
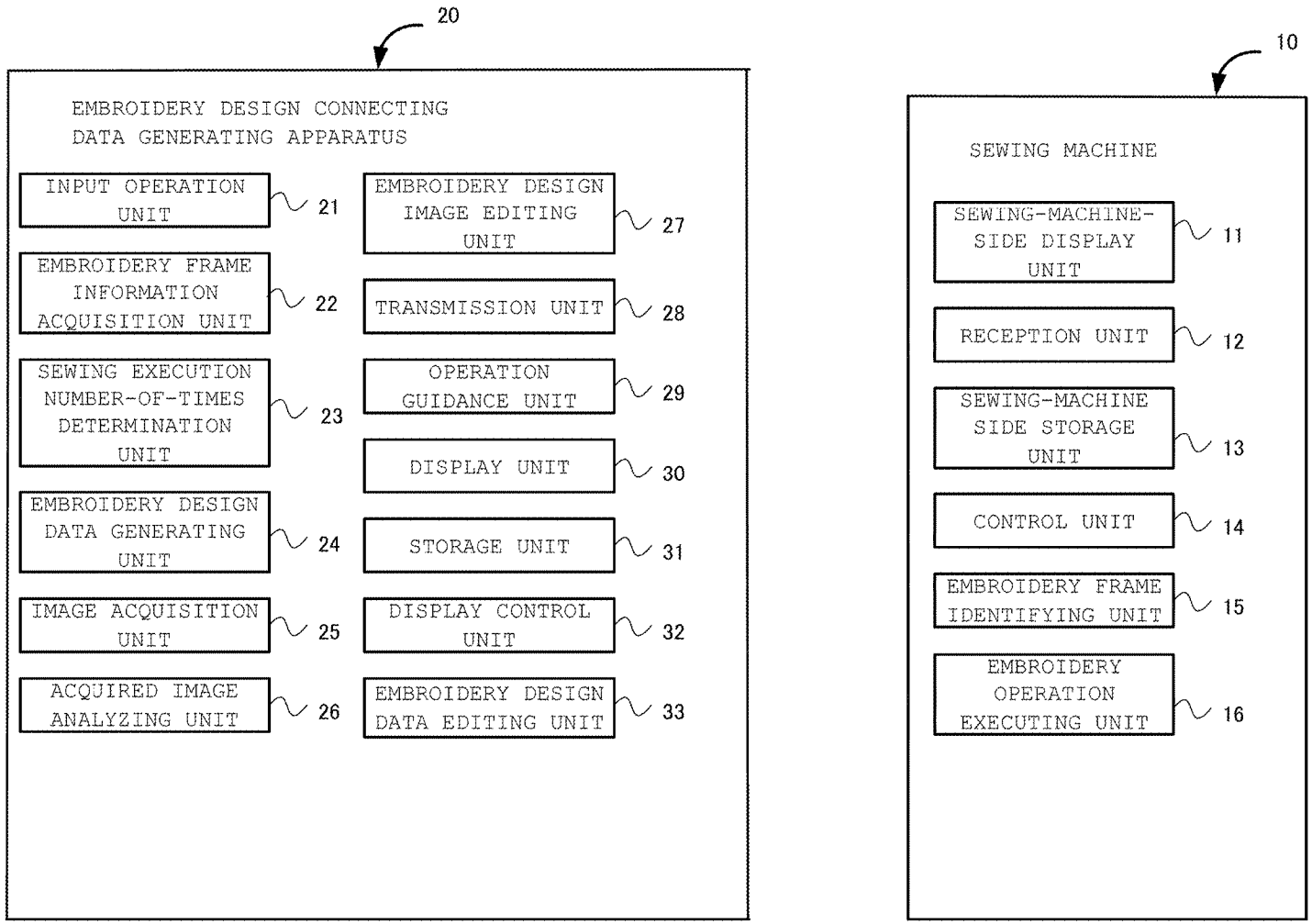
FIG. 2 is a diagram showing an electrical configuration of the sewing system according to the embodiment of the present invention.

As shown in FIG. 2, the sewing machine 10 comprises a sewing-machine-side display unit 11, a reception unit 12, a sewing-machine-side storage unit 13, a control unit 14, an embroidery frame identifying unit 15, and an embroidery operation executing unit 16. Here, the sewing machine 10 provides semi-automatic embroidery using multiple threads having different colors according to the embroidery data, for example. In addition, the sewing machine 10 is configured as a multi-function sewing machine that supports ordinary sewing according to various kinds of sewing patterns.

The sewing-machine-side display unit 11 is provided to the sewing machine 10 itself. For example, the sewing machine-side-display unit 11 is configured as a liquid crystal display apparatus. The sewing-machine-side display unit 11 displays various kinds of information useful for the user according to the sewing machine operating state. For example, in a threading operation, the sewing-machine-side display unit 11 displays content for assisting the user to perform the threading operation. The sewing machine 10 is configured as a multi-function sewing machine. Accordingly, various kinds of content to be displayed are prepared. Also, the sewing-machine-side display unit 11 is configured as a touch panel to allow the user to input various operation instructions.

The reception unit 12 is connected to the tablet terminal 20 via the wireless LAN 60. This enables wireless bidirectional communication between the sewing machine 10 and the tablet terminal 20 via an unshown router or the like. It should be noted that the present invention is not restricted to such an arrangement employing a network such as the wireless LAN 60 or the like. For example, a communication system may be employed using Bluetooth (trademark). Also, an off-line communication system may be employed using USB memory 70 or the like, for example. In the present embodiment, the reception unit 12 receives embroidery design data generated or edited by the tablet terminal 20 configured as an embroidery design connecting data generating apparatus. Otherwise, the reception unit 12 receives image data of an embroidery design edited via an embroidery design image editing unit of the tablet terminal 20.

The sewing-machine-side storage unit 13 is configured as ROM (Read Only Memory), RAM (Random Access Memory), flash memory, or the like, and stores several hundred kinds of embroidery design data, for example. Also, in addition to the designs (embroidery design data) and the information with respect to the embroidery frame stored beforehand in the sewing machine 10, the sewing-machine-side storage unit 13 may store additional designs (user-prepared designs) which are obtained by the user from external data. Also, the sewing-machine-side storage unit 13 is configured to allow the data stored in it, such as the embroidery design data, the information relating to the embroidery design data, and the information with respect to the embroidery frame, to be transmitted to the tablet terminal 20.

The control unit 14 controls the operation of the sewing machine 10 according to the control program. Furthermore, the control unit 14 performs a response operation according to an inquiry from the tablet terminal 20. In addition, the control unit 14 is capable of performing a control operation so as to allow the user to perform simple data editing operations such as selection, mixing, modification, etc., on the embroidery designs using the sewing machine 10 alone with the display function and the input function of the sewing-machine-side display unit 11.

The embroidery frame identifying unit 15 identifies the kind of the embroidery frame 40 mounted on the sewing machine 10. The embroidery frame identifying unit 15 according to the present embodiment identifies the kind of the embroidery frame 40 mounted on the sewing machine 10 by way of the kind of the embroidery frame 40 input or otherwise selected by the user via the sewing-machine-side display unit 11. It should be noted that the method used by the embroidery frame identifying unit 15 for identifying the embroidery frame 40 is not restricted to such an arrangement. Also, the kind of the embroidery frame 40 mounted on the sewing machine 10 may be identified using an IC chip or a contact circuit.

The sewing operation executing unit 16 executes a sewing operation for a cloth stretched over the embroidery frame 40 such that the adjacent embroidery designs are connected to each other so as to form a single stippling design according to the edited embroidery design data or otherwise the edited image data of the embroidery design acquired from the tablet terminal 20 via the reception unit 12. In a case in which the reception unit 12 receives the image data of the embroidery design, the embroidery design data stored in the sewing machine 10 is edited and modified based on the image data thus received. Furthermore, the sewing machine 10 performs sewing of the embroidery design according to the embroidery design data thus edited.

The tablet terminal 20, which is employed as the embroidery design connecting data generating apparatus, may be configured as a commercially available general-purpose tablet terminal. Before such a tablet terminal 20 is used as the embroidery design connecting data generating apparatus according to the present embodiment, a program for supporting such a sewing system (an application program) is installed on the tablet terminal 20. It should be noted that such an issue may be recorded on a recording medium such as a flash memory device or the like. Also, such an issue may be obtained by downloading via various kinds of known networks.

It should be noted that description is being made in the present embodiment regarding such a tablet terminal 20 as a specific example of the embroidery design connecting data generating apparatus. However, the present invention is not restricted to such an arrangement. Also, a smartphone may be employed, for example. Alternatively, a camera or the like having a function required to function as the embroidery design connecting data generating apparatus may be employed, which is mounted on the sewing machine 10 by means of a mechanism that allows it to be fixedly mounted at a position where it can acquire an image of the overall area of the embroidery frame.

As shown in FIG. 2, the tablet terminal 20 comprises an input operation unit 21, an embroidery frame information acquisition unit 22, an embroidery execution number-of-times determination unit 23, an embroidery design data generating unit 24, an image acquisition unit 25, an acquired image analyzing unit 26, an embroidery design image editing unit 27, a transmission unit 28, an operation guidance unit 29, a display unit 30, a storage unit 31, a display control unit 32, and an embroidery design data editing unit 33.

The input operation unit 21 allows the user to input operating instructions. In the present embodiment, examples of such information to be received by the input operation unit 21 include: information with respect to the size of the area of a cloth to be subjected to embroidery sewing; and information with respect to editing of the embroidery design data with respect to the embroidery frame.

The embroidery frame information acquisition unit 22 acquires the information with respect to the embroidery frame 40 to be used. For example, the tablet terminal 20 instructs the display unit 30 to display a frame list with respect to the embroidery frames, and prompts the user to select the embroidery frame to be used. The embroidery frame information acquisition unit 22 acquires the information with respect to the size and so on of the embroidery frame 40 to be used.

The sewing execution number-of-times determination unit 23 determines the number of times the sewing design is to be executed, based on the information with respect to the embroidery frame 40 acquired by the embroidery frame information acquisition unit 22 and the size of the area to be subjected to embroidery received via the input operation unit 21.

The embroidery design data generating unit 24 generates embroidery design data for the overall embroidery area based on the information with respect to the embroidery frame 40 acquired by the embroidery frame information acquisition unit 22 and the size of the area of the cloth to be subjected to embroidery received via the input operation unit 21. It should be noted that description is being made in the present embodiment regarding an arrangement in which embroidery sewing is repeatedly performed for a single design such as a stippling design or the like having the same shape and the same size, so as to form a single embroidery design over the entire area. Also, such embroidery sewing may be performed for multiple designs such as stippling designs or the like having the same shape and different sizes, so as to form a single embroidery design over the entire area. Also, such embroidery sewing may be performed for multiple designs having different shapes, so as to form a single embroidery design over the entire area. Specifically, embroidery sewing may be performed such that a triangular design is provided at a position adjacent to a rectangular design, for example.

The image acquisition unit 25 acquires an image in a state in which the embroidery frame 40 and the cloth mounted on the embroidery frame 40 are within the image acquisition range. Furthermore, the image acquisition unit 25 repeatedly performs image acquisition with priority given to a region that is not adjacent to other regions to be subjected to the embroidery design sewing in the subsequent operation every time the sewing machine 10 executes the embroidery design sewing. The number of times the image acquisition is to be performed matches the number of times the embroidery design sewing is to be executed (except for the number of times the embroidery design sewing has already been executed), which is determined by the embroidery execution number-of-times determination unit 23. Furthermore, when judgment has been made that alignment has been obtained in the image displayed on the display unit between the reference embroidery frame image and the embroidery frame 40 mounting the cloth which is a sewing target, the image acquisition unit 25 automatically performs image acquisition.

The acquired image analyzing unit 26 performs image analysis so as to acquire a correspondence between the information with respect to the embroidery frame 40 acquired by the embroidery frame information acquisition unit 22 and the information with respect to the image of the embroidery frame 40 acquired by the image acquisition unit 25. Furthermore, the acquired image analyzing unit 26 analyzes the correspondence between the information with respect to the embroidery frame 40 and the information with respect to the image of the embroidery frame in the acquired image based on the image acquired in a state in which there is approximate alignment between the image of the embroidery frame displayed on the display unit via the image acquisition unit 25 and the reference embroidery frame image displayed on the display unit based on the information with respect to the embroidery frame 40 acquired by the embroidery frame information acquisition unit 22.

The embroidery design image editing unit 27 edits an embroidery design image to be provided to the cloth such that it is connected with another embroidery design formed at a portion of the cloth in the image displayed on the display unit 30. Specifically, by shifting at least one from among a vertex or otherwise a side of the outer shape of the embroidery design having a polygonal shape displayed on the display unit, the embroidery design image editing unit 27 edits and modifies the embroidery design image. Furthermore, the embroidery design data editing unit 33 edits and modifies the embroidery design data based on the embroidery design image thus edited.

The transmission unit 28 transmits, to the sewing machine 10, the data of the embroidery design image edited by the embroidery design image editing unit 27 or otherwise the embroidery design data edited based on the embroidery design image edited by the embroidery design image editing unit 27.

The operation guidance unit 29 provides guidance to the user in the form at least one from among a guidance display and audio guidance, in order to instruct the user to repeatedly perform image acquisition multiple times with priority given to a region that is not adjacent to other regions to be subjected to the embroidery design sewing in the subsequent operation. The number of times the image acquisition is to be performed corresponds to the number of times sewing of the embroidery design is to be executed, which is determined by the embroidery execution number-of-times determination unit 23. Furthermore, the operation guidance unit 29 provides image acquisition guidance to the user indicating that the user is to perform image acquisition in a state in which the image of the embroidery frame 40 is aligned with the reference embroidery frame image displayed on the display unit 30 based on the information with respect to the shape, size, or the like of the embroidery frame acquired by the embroidery frame information acquisition unit 22. By providing such guidance, such an arrangement allows the user to easily perform the operation with the tablet terminal 20 even if the user is inexperienced in the use of the tablet terminal 20.

The display unit 30 displays various kinds of images, and is configured including an unshown operating unit having a function as a touch panel. In addition to a function of displaying information, such an arrangement allows the user to input various kinds of operating instructions. In the present embodiment, the display unit 30 displays the reference embroidery frame image in a semi-transparent manner. Accordingly, the display unit 30 displays the embroidery frame having a known size or the like and the video image input via the image acquisition unit 25 in a superimposed manner. This allows the user to easily obtain alignment between them.

The storage unit 31 is configured as ROM (Read Only Memory), RAM (Random Access Memory), flash memory, or the like. For example, the storage unit 31 stores the image data acquired by the image acquisition unit 25 and various kinds of data acquired from the sewing machine 10. It should be noted that, in the present embodiment, the storage unit 31 stores the embroidery frame information, sewing data, operation guidance program, audio data, display data, and the like. The display control unit 32 controls the display operation of the display unit 30. In the present embodiment, the reference image of the embroidery frame is displayed in a semi-transparent manner. Furthermore, such an arrangement displays, in a superimposed manner, the reference embroidery frame image thus displayed in a semi-transparent manner and the video image of the embroidery frame to be used by the user input via the image acquisition unit 25.

[Operation of the Sewing System]

Description will be made with reference to FIGS. 3 through 14 regarding the operation of the sewing system according to the present embodiment.

Figure 5:
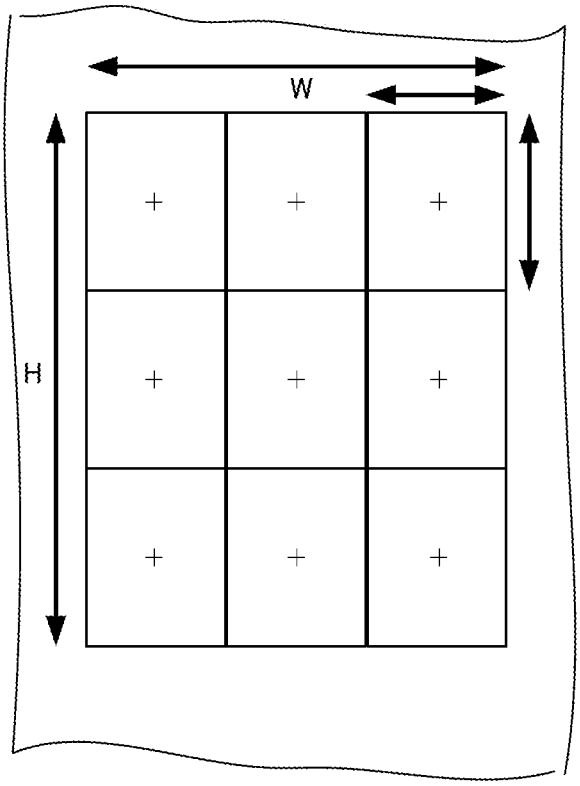
FIG. 5 is a diagram showing an example of a layout of a stippling design on a cloth before a decision according to the embodiment of the present invention.

After the sewing application installed on the tablet terminal 20 is started up, the user inputs the information with respect to the area of the cloth to be subjected to the embroidery. Specifically, as shown in FIG. 5, the user specifies the vertical length and the horizontal length as the size of the area of the cloth to be subjected to embroidery. Description will be made below regarding an example in which the user inputs the horizontal length W=570 mm and the vertical length H=630 mm.

Figure 7:
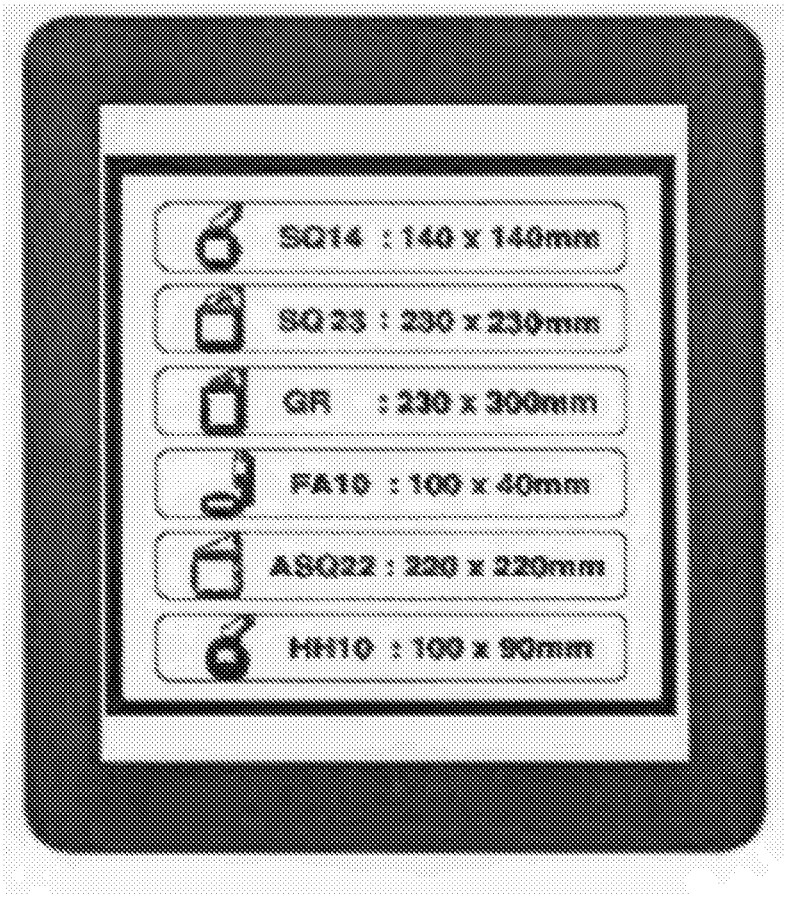
FIG. 7 is a diagram showing an example state according to the embodiment of the present invention in which multiple kinds of embroidery frames are displayed on a display screen of an embroidery design connecting data generating apparatus in order to allow the user to select the embroidery frame to be used to mount the cloth.

The embroidery frame information acquisition unit 22 prompts the user to specify the kind of the embroidery frame 40 to be used (Step S101). Specifically, the embroidery frame information acquisition unit 22 displays a list as shown in FIG. 7, and identifies the kind of the embroidery frame 40 to be used in embroidery by way of the kind of the embroidery frame 40 selected by the user from the items on the list. Description will be made below regarding a case in which the frame type GR is selected. It should be noted that the storage unit 31 stores the data such as the sizes of the various kinds of the embroidery frame 40. Also, such data may be acquired via communication with the sewing machine 10 or otherwise a server or the like connected to different networks. It should be noted that description has been made above regarding an arrangement in which the user specifies the kind of the embroidery frame 40. Also, the embroidery frame information acquisition unit 22 may identify the kind of the embroidery frame 40 to be used in embroidery based on the image acquired by the image acquisition unit 25, and may acquire the information with respect to the embroidery frame 40 thus identified. For example, the image acquired by the image acquisition unit 25 may be analyzed so as to identify the kind of the embroidery frame 40 based on the shape of the embroidery frame 40 in the acquired image. Also, image recognition may be performed for a text, barcode, or the like, provided on the embroidery frame 40, so as to identify the kind of the embroidery frame 40.

Judgement is made based on the information with respect to the area of the cloth to be subjected to the embroidery sewing input by the user whether or not each stippling embroidery design can be accommodated within the area of the cloth thus specified. The judgment is sequentially made for the multiple stippling designs having different patterns prepared beforehand in descending order of the size of the embroidery design. When judgment has been made that a given embroidery design can be approximately accommodated within the area, size adjustment is performed within ±10% so as to provide an embroidery design having an appropriate size. In this stage, the number of times the cloth is mounted on the embroidery frame (the number of times the embroidery sewing is performed) and the embroidery design are determined (Step S102). For example, in a case of employing stippling data for an embroidery design having a size of 200 mm×200 mm, there is a need to arrange (3×3) embroidery designs in both the vertical direction and the horizontal direction. In this case, the original embroidery design has a horizontal length that is greater than those of the embroidery designs to be arranged. Thus, the size of the original embroidery design is reduced to 95% in the horizontal direction. On the other hand, the original embroidery design has a vertical length that is smaller than those of the embroidery designs to be arranged. Thus, the size of the original embroidery design is enlarged to 105% in the vertical direction. That is to say, in this case, such an arrangement generates a modified embroidery design having a size of 190 mm×210 mm.

Figure 6:
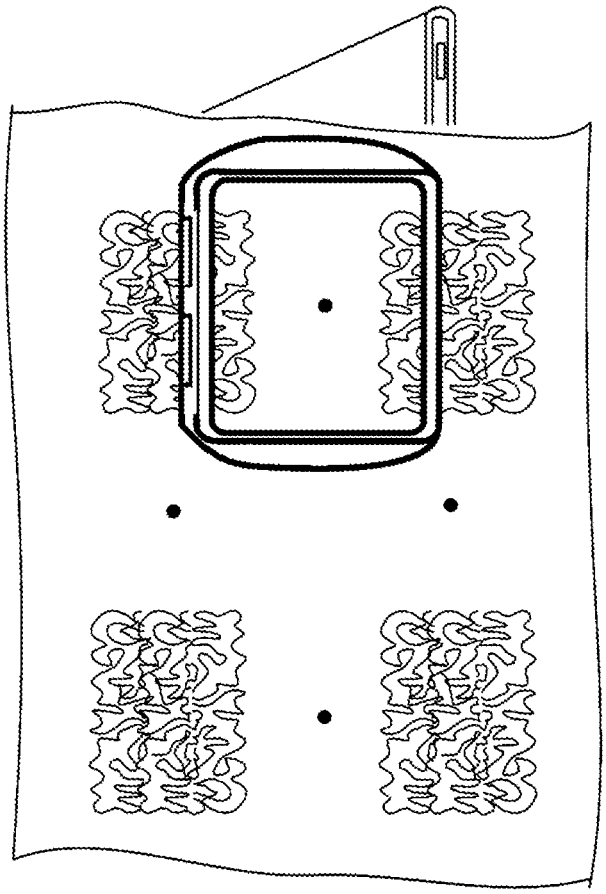
FIG. 6 is a diagram showing an example method according to the embodiment of the present invention for sewing a stippling design in the form of a single continuous design.

The embroidery design data generated in Step S102 is transmitted via the transmission unit 28 to the sewing machine 10 (Step S103). For example, in a case in which the embroidery design sewing is performed (3×3) times in units of the size thus specified along the horizontal direction and the vertical direction, and in a case in which the portion of cloth mounted on the embroidery frame is replaced by a subsequent portion every time the design connecting sewing is performed, a mark is provided to each center position of nine design areas each of which is to be mounted on the embroidery frame 40. First, as shown in FIG. 6, the stippling design having a size of 190 mm×210 mm determined in Step S102 is sewn in each of the four design areas positioned at the four corners of the cloth from among the nine design areas of the cloth thus marked. The design area of the cloth is mounted on the embroidery frame 40 such that the corresponding mark matches the center of the embroidery frame 40 before the stippling design is sewn.

Figure 8:
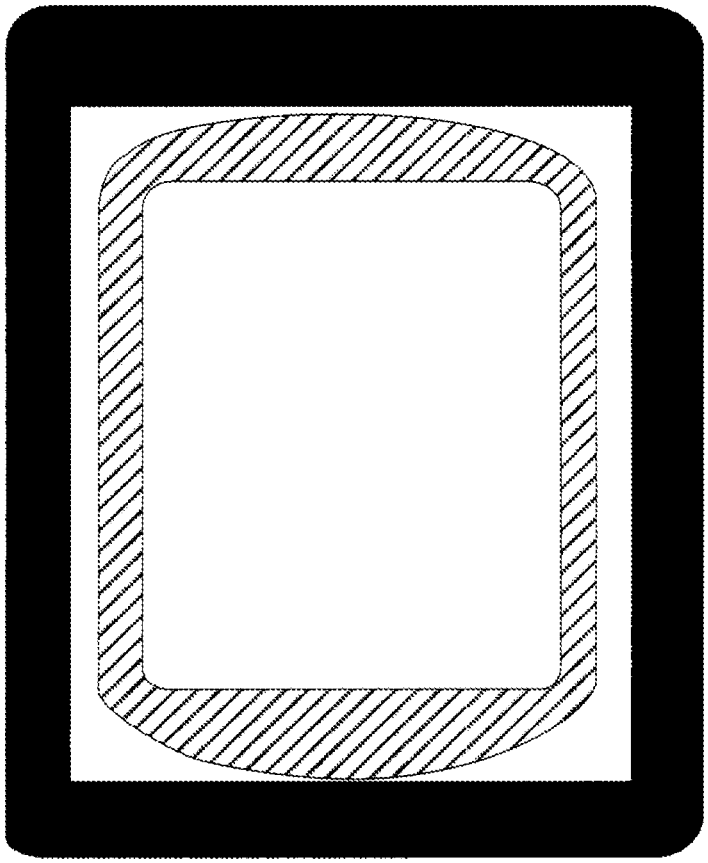
FIG. 8 is a diagram showing an example state according to the embodiment of the present invention in which the selected embroidery frame to be used to mount the cloth is displayed on the display screen of the embroidery design connecting data generating apparatus.

Next, the stippling design sewing is sequentially performed for each of the five remaining portions, which are each configured as a space. Before the stippling design sewing, there is a need to adjust the size of the stippling design such that it is appropriately fitted to the space. In order to provide such adjustment, an operation is performed as follows. That is to say, as shown in FIG. 6, the cloth is mounted on the embroidery frame such that the mark provided to the center position of the space area (gap area) approximately matches the center position of the embroidery frame. As shown in FIG. 8, the reference frame image acquired by the embroidery frame information acquisition unit 22 is displayed in a semi-transparent manner, and the camera function is started up (Step S104).

Figure 9:
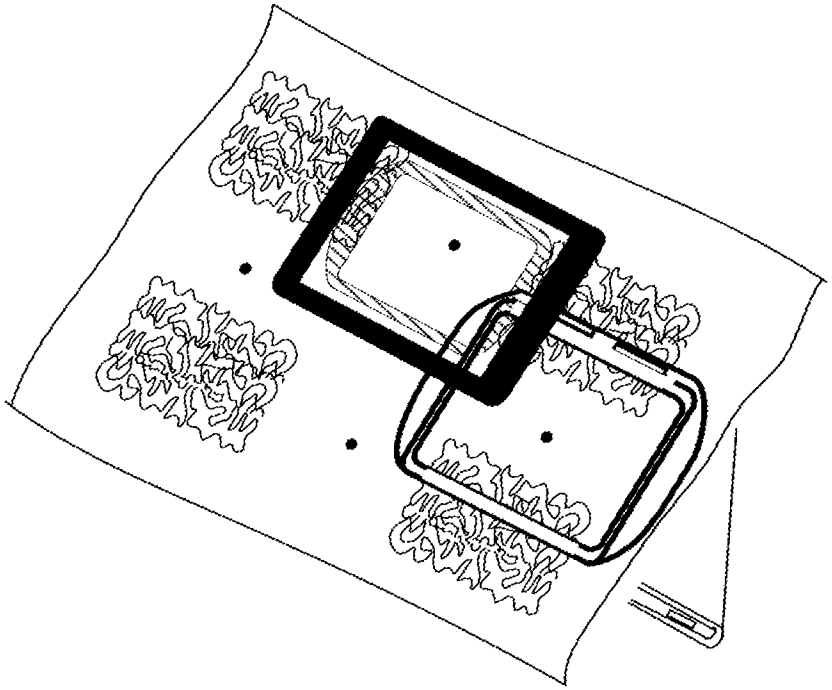
FIG. 9 is a diagram showing an example of an alignment step according to the embodiment of the present invention in which the selected embroidery frame and the actual embroidery frame mounting the cloth having a portion to which a stippling design has been sewn are displayed in a superimposed manner before the image acquisition.
Figure 10:
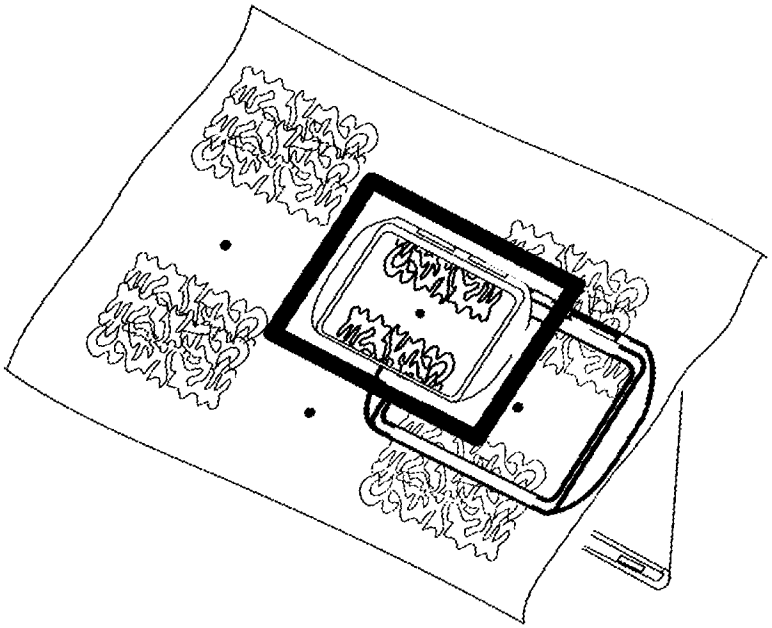
FIG. 10 is a diagram showing an example state according to the embodiment of the present invention in which image acquisition is performed in a state in which the selected embroidery frame and the actual embroidery frame mounting the cloth having a portion to which a stippling design has been sewn are displayed in a superimposed manner.

As shown in FIG. 9, the user holds the tablet terminal 20 such that it is positioned above the embroidery frame 40. In this state, the user adjusts the image acquisition position such that an image of the embroidery frame 40, which is the image acquisition target, is aligned with the reference embroidery frame image displayed in a semi-transparent manner on the tablet terminal 20. It should be noted that, in this stage, the operation guidance unit 29 is started up, and assists the user by means of a guidance display or otherwise audio guidance to perform the position adjustment such that the reference frame image displayed in a transparent manner is aligned with the embroidery frame 40 which is the image acquisition target. By providing such a guidance function, such an arrangement allows the user to perform position alignment between the reference frame image displayed in a semi-transparent manner and the acquired image of the embroidery frame 40 in a short period of time even if the user is inexperienced in image acquisition using the tablet terminal 20. As shown in FIG. 10, when the video image of the embroidery frame input via the camera is aligned with the reference frame image displayed in a semi-transparent manner on the tablet screen, the user presses a shutter button (Step S105). It should be noted that image analysis may be performed for the reference embroidery frame image and the video image of the embroidery frame thus input. In this case, when judgment has been made based on the image analysis result that such alignment has been obtained between them, the shutter button may be automatically pressed. By providing such an automatic shutter operation based on the image analysis result, such an arrangement is capable of accurately acquiring an image without involving the effects of camera shake or the like. When the embroidery frame 40 in the acquired image is aligned with the reference frame image such that they match each other, such an arrangement is capable of acquiring the correspondence between the acquired image and the actual scale based on the information with respect to the embroidery frame 40 acquired by the embroidery frame information acquisition unit 22 using the fact that the size of the embroidery frame 40 is known. Also, marks may be provided to the embroidery frame 40 at particular positions such as corners or the like such that they can be identified visually. With such an arrangement, the position of the tablet terminal 20 may be adjusted such that the marks thus provided to the embroidery frame in the acquired image are aligned with the corresponding marks provided to the reference embroidery frame image displayed on the display unit of the tablet terminal 20.

Figure 11:
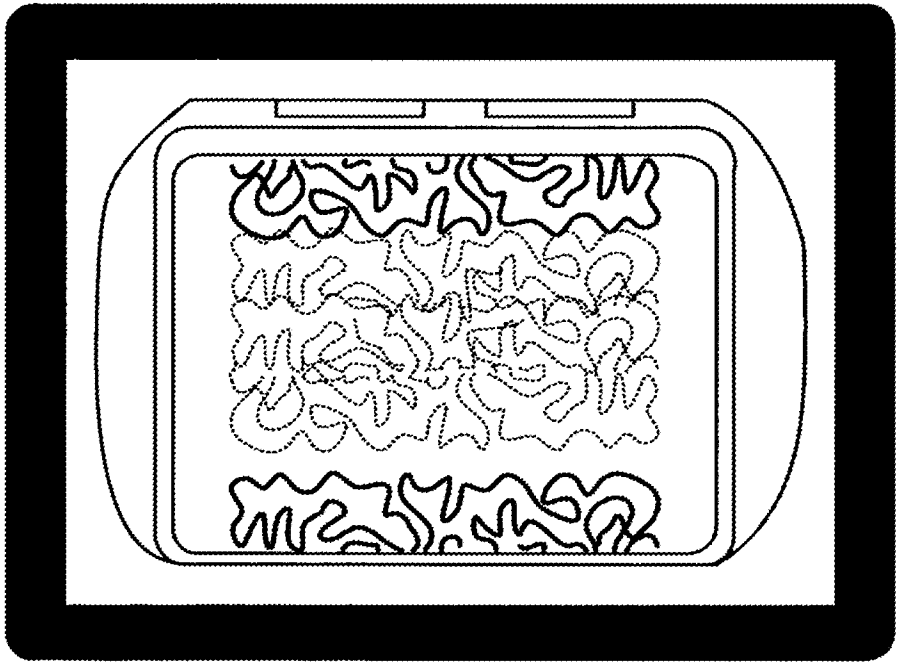
FIG. 11 is a diagram showing an example state according to the embodiment of the present invention in which the embroidery design connecting data generating apparatus displays, on its display screen, a combination of a stitch image of a stippling design to be sewn in the subsequent step and an acquired image of the embroidery frame and the cloth.

The stitch image that forms the embroidery design is displayed in the space area (gap area) on the display screen of the tablet terminal 20 (Step S106). If the previous stippling designs have been accurately provided in the embroidery sewing without involving the occurrence of shrinkage that occurs in the sewing operation, the video images of the stippling designs acquired by the camera are displayed together with the stitch image such that they are arranged without a gap. However, in many cases, as shown in FIG. 11, they are arranged with a non-negligible gap due to shrinkage that occurs in the sewing operation, alignment errors that occur when the cloth is mounted on the embroidery frame, or the like.

Figure 4:
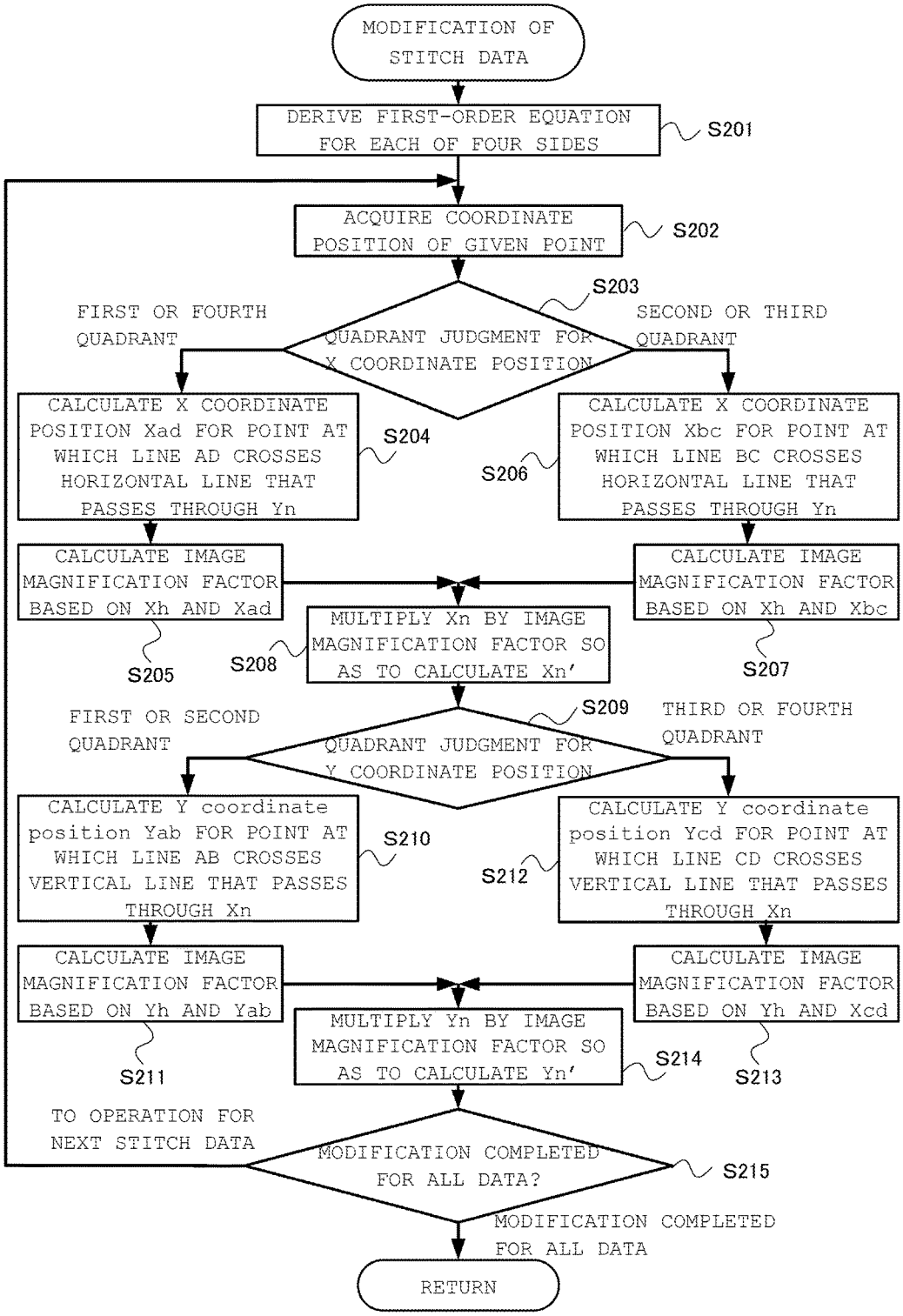
FIG. 4 is a flowchart showing the electrical operation in detail for modifying stitch data according to the embodiment of the present invention.
Figure 12:
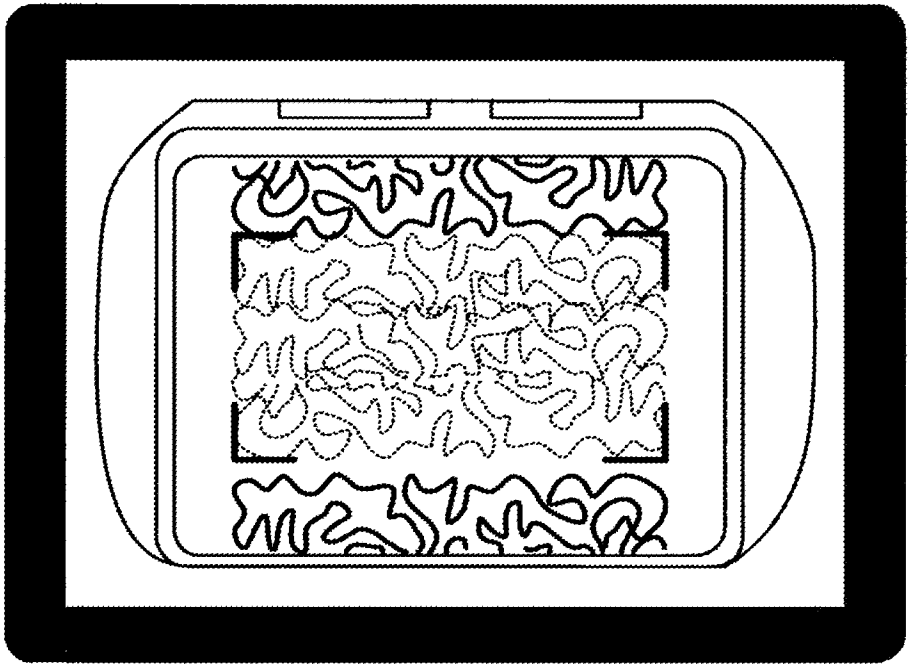
FIG. 12 is a diagram showing an example state according to the embodiment of the present invention in which cursor marks are displayed at the four corners of the stitch image after the layout of the stitch image of the stippling design to be connected is determined.
Figure 13:
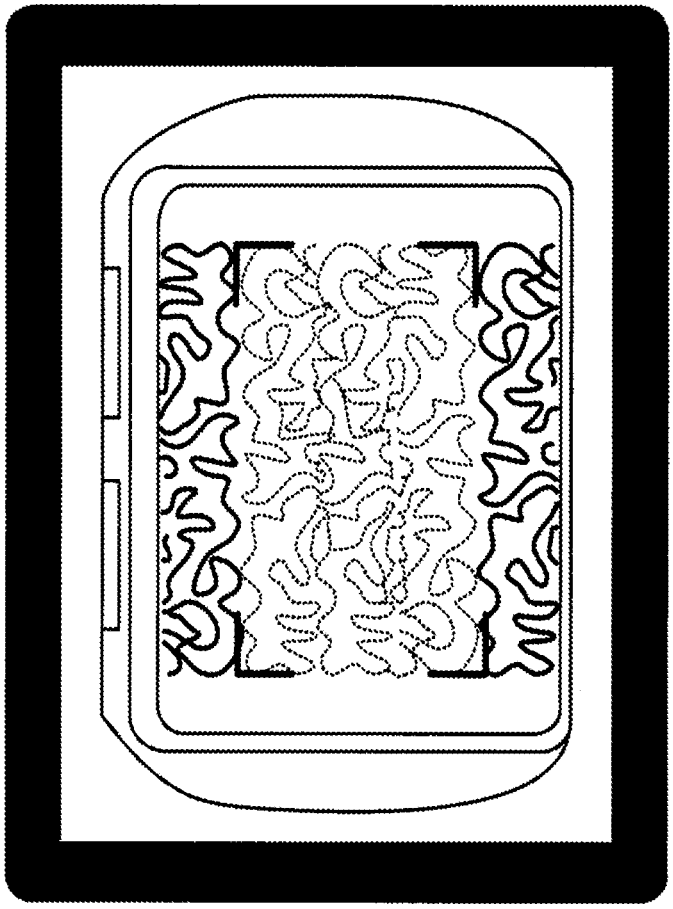
FIG. 13 is a diagram showing an example state according to the embodiment of the present invention in which the cursor marks displayed at the four corners of the stitch image are dragged in order to adjust the size or shape of the stitch image.
Figure 14:
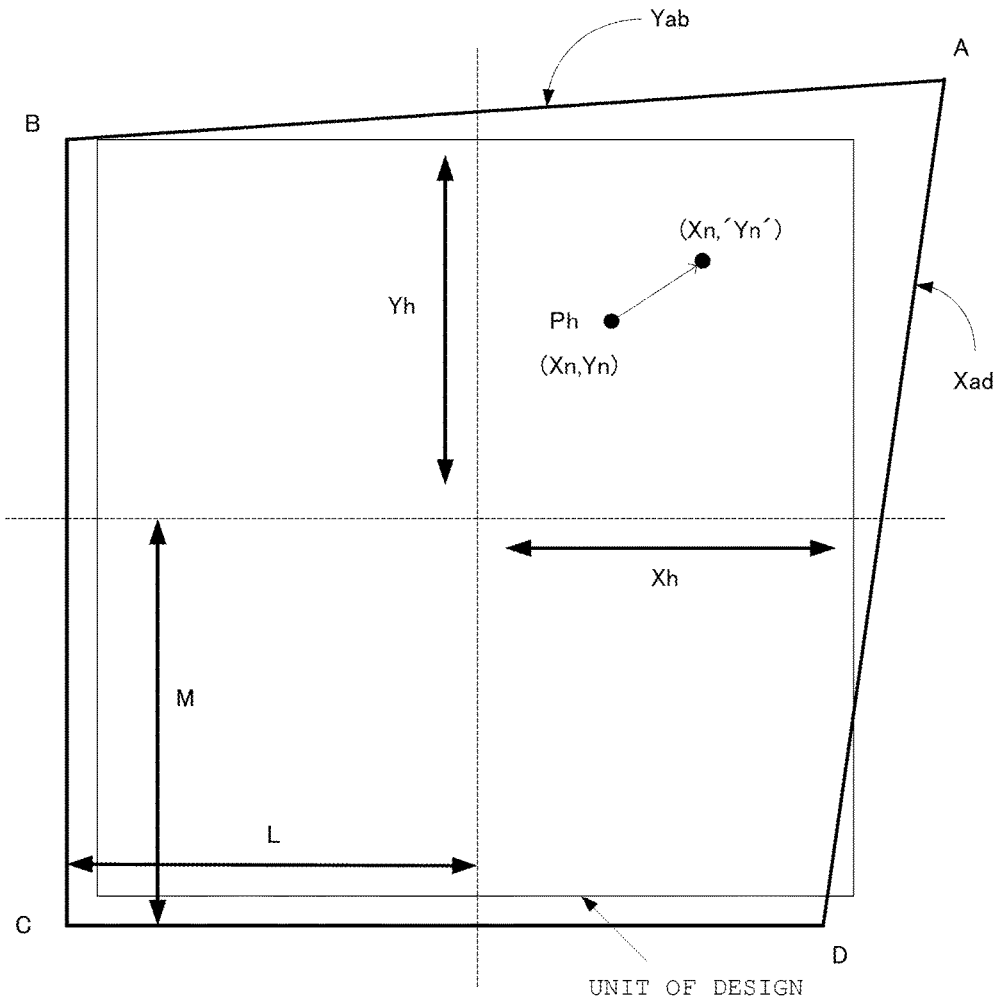
FIG. 14 is a diagram for explaining the modification of the stitch data according to the embodiment of the present invention.

When the user taps the area of the stitch image, as shown in FIG. 12, cursor marks are displayed at the four corners of the image. As shown in FIG. 13, the user drags the cursors to the desired corners of the stippling image such that they are connected to the stitch image, so as to adjust the stitch image (Step S107). Such a dragging operation may be performed by the user using a finger or otherwise a stylus, which is readily conceivable. Also, in a case in which such an arrangement is capable of performing image recognition so as to detect an embroidery region of a cloth having an embroidery design beforehand, the stitch image may be automatically dragged such that it is connected with the embroidery region thus detected. It should be noted that description has been made in the present embodiment regarding an example in which such cursor marks are displayed at the four corners. Also, such cursor marks may be displayed between the adjacent corners of the four corners, for example. FIG. 14 shows an extreme example. In this example, the four corners A, B, C, and D are dragged such that they match the stippling image, thereby defining a new rectangle ABCD. The coordinate positions of the vertexes of the rectangle ABCD are supplied to Step S108. In Step S108, the stitch data is modified such that it defines a given stippling embroidery design. It should be noted that the modification method is described in a subroutine as shown in FIG. 4. The embroidery design image editing unit edits the stitch data using the modification method. The embroidery design data editing unit 33 edits and modifies, based on the stitch image thus edited, the embroidery design data generated by the embroidery design data generating unit 24. The embroidery design data thus edited and modified is used as the embroidery design data to be used in embroidery.

The embroidery design data thus edited and modified is transmitted to the sewing machine 10 (Step S109), and the embroidery frame is mounted on the sewing machine 10 in the same state as it was when image acquisition was performed. In this state, the sewing machine 10 performs a sewing operation, thereby providing a stippling design without a sewing gap. Furthermore, such operations represented by Steps S104 through S109 are repeatedly executed for the remaining spaces between the embroidery designs (Step S110). The data to be transmitted to the sewing machine 10 is not restricted to the aforementioned embroidery design data thus edited and modified. Also, the image data of the embroidery design edited by the embroidery design image editing unit 27 may be transmitted to the sewing machine 10. In this case, after the sewing machine 10 receives the image data, the sewing machine 10 itself edits and modifies the embroidery design data recorded in the sewing machine 10, based on the image data thus received. The sewing machine 10 performs a sewing operation according to the sewing design data thus edited.

[Modification Operation for Stitch Data]

Description will be made with reference to FIGS. 3, 4, and 14 regarding a modification operation for the stitch data according to the present embodiment.

As shown in FIG. 14, the stitch data is defined with the coordinate position of the center of the design as (0, 0). Coordinate values in the right region and in the upper region have positive values, and coordinate values in the left region and in the lower region have negative values. With the stitch data thus defined, a coordinate position (X, Y) is defined for each needle location point.

Figure 3:
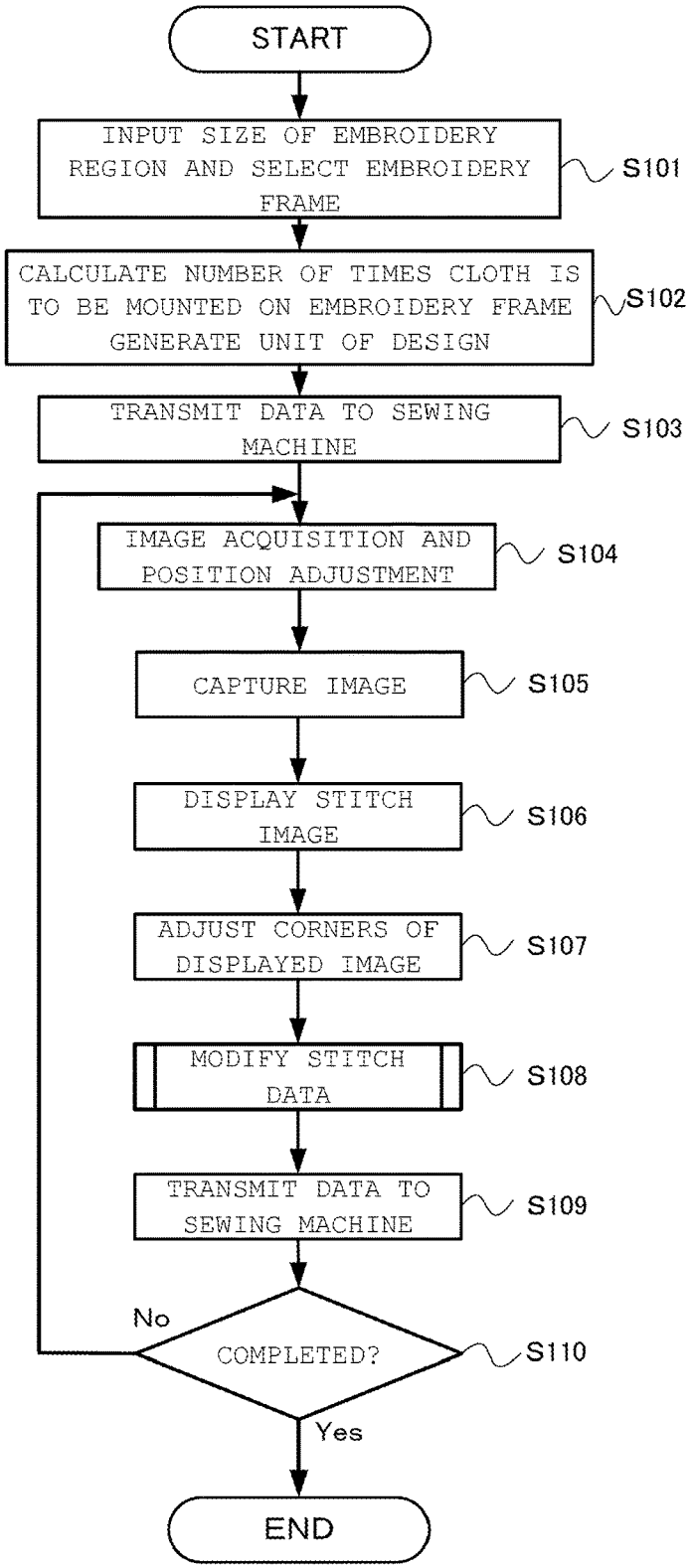
FIG. 3 is a diagram showing an electrical operation of the sewing system according to the embodiment of the present invention.

First, a first-order equation is derived for each side of the rectangle ABCD based on the coordinate positions of the vertexes of the rectangle ABCD thus obtained in Step S107 shown in FIG. 3 (Step S201). In the case shown in FIG. 4, the slope can be defined for the lines AD and AB.

Accordingly, the lines AD and AB can each be represented by the expression $y=a \cdot x+b$. Here, "a" represents the slope, and "b" represents the intercept. On the other hand, the lines BC and CD have an undefined slope and a zero slope, respectively, so they are represented by $x=-L$ and $y=-M$, respectively.

The coordinate position of a given needle location point Pn is acquired (Step S202). Next, judgment is made whether the X coordinate position of the needle location point Pn belongs to the first or fourth quadrant or belongs to the second or third quadrant (Step S203). When judgment has been made that the X coordinate position belongs to the first or fourth quadrant (Step S203), the X coordinate position Xad is calculated for a point at which the line AD crosses a horizontal line that passes through the Y coordinate position Yn of the needle location point (Step S204). The image magnification factor is calculated based on the ratio between Xad and half the width of the embroidery design data, i.e., Xh (Step S205). Next, the X coordinate position Xn of the needle location point Pn is multiplied by the image magnification factor thus calculated so as to calculate a modified X coordinate position Xn' (Step S208).

On the other hand, when judgment has been made that the X coordinate position belongs to the second or third quadrant (Step S203), the slope is undefined. In this case, the linear equation to be used is represented by $X=-L$, and accordingly, the X coordinate position is set to a constant value regardless of the Y coordinate position (Step S206). Thus, the image magnification factor is calculated based on the ratio between Xh and L (Step S207).

Next, judgment is made whether the Y coordinate position of the needle location point Pn belongs to the first or second quadrant or belongs to the third or fourth quadrant (Step S209). When judgment has been made that the Y coordinate position belongs to the first or second quadrant (Step S209), the Y coordinate position Yab is calculated for a point at which the line AB crosses a vertical line that passes through the X coordinate position Xn of the needle location point (Step S210). The image magnification factor is calculated based on the ratio between Yab and half the height of the embroidery design data, i.e., Yh (Step S211). Next, the Y coordinate position Yn of the needle location point Pn is multiplied by the image magnification factor thus calculated so as to calculate a modified Y coordinate position Yn' (Step S214).

On the other hand, when judgment has been made that the Y coordinate position belongs to the third or fourth quadrant (Step S209), the slope is zero. In this case, the linear equation to be used is represented by $Y=-N$, and accordingly, the Y coordinate position is set to a constant value regardless of the X coordinate position (Step S212). Thus, the image magnification factor is calculated based on the ratio between Yh and N (Step S213).

Next, the coordinate position (Xn, Yn) of the needle location point Pn is modified based on the rectangle ABCD into the coordinate position (Xn', Yn'), which is employed as a new needle location point. Such operations represented by Steps S201 through S214 are performed for all the stitch data, thereby modifying the stitch data for the embroidery design such that it is accommodated within the rectangle ABCD.

Effects of the Present Embodiment

As described above, with the present embodiment, in a case in which multiple stippling embroidery designs are connected so as to form a single large stippling design, in the first step, the stippling designs are intentionally sewn discontinuously, instead of sewing the multiple embroidery designs continuously. In the second step, a rectangular embroidery design to be provided in the subsequent sewing is modified such that it matches a space between the adjacent embroidery designs that varies due to shrinkage that occurs in the sewing operation, alignment error that occurs when the cloth is mounted on the embroidery frame, or the like. Thus, such an arrangement has an advantage of providing embroidery such that the stippling design fits such a space between the adjacent embroidery designs.

After a cloth to which discontinuous stippling designs have been sewn is stretched over an embroidery frame having a known size, an image of the cloth is acquired together with the external appearance of the embroidery frame. Thus, such an arrangement is capable of acquiring image magnification factor information. Furthermore, the sewing image for the stippling designs is displayed on the acquired video image in a superimposed manner with the image magnification factor thus acquired. Thus, such an arrangement allows the user to visually check the level of deviation of the sewing image and to check for overlapping or gaps. Moreover, by dragging the cursors displayed at the four corners of the sewing image to optimum positions such that they match the space displayed on the screen, such an arrangement allows the user to modify the embroidery data such that it fits a space defined by the four corners.

It should be noted that description has been made above regarding an example in which the multiple stippling embroidery designs are arranged discontinuously. However, in some cases, a gap occurs between the adjacent embroidery designs due to accumulated shrinkage or the like that occurs in the sewing operation even after the multiple embroidery designs are arranged continuously. In this case, such a gap is preferably filled with an embroidery design in the final adjustment. The technique disclosed in the present embodiment is applicable to such an arrangement. Specifically, the rectangular stippling embroidery design is adjusted such that it is accommodated within a remaining space, thereby appropriately arranging such a stippling design in a desired area of the cloth to be subjected to embroidery.

Also, the present embodiment is applicable to connecting multiple separate designs in addition to the stippling design sewing. With conventional techniques, a connecting design is shifted in parallel or is rotated so as to connect adjacent designs. However, in some cases, it is difficult for such simple editing functions to connect the adjacent designs. With the technique according to the present embodiment, such an arrangement further provides a function of modifying the shape of the design according to the outline of an adjacent design, thereby providing an advantage of allowing the adjacent designs to be connected in a simple manner without a gap between them.

It should be noted that the operation of the sewing system or the embroidery design connecting data generating apparatus may be recorded on a computer-system-readable or computer-readable recording medium in the form of a program. Also, such a program thus recorded on the recording medium may be read out and executed by the sewing system or the embroidery design connecting data generating apparatus, thereby providing the sewing system or the embroidery design connecting data generating apparatus according to the present invention. Examples of such a computer system or computer as used here include an operating system and a hardware component such as peripheral devices or the like.

Also, the "computer system" or "computer" encompasses website providing environments (or display environments) that employ the WWW (World Wide Web) system. Also, the aforementioned program may be transmitted to other computer systems or computers from a given computer system or computer that stores this program in its storage apparatus or the like via a transmission medium or otherwise transmission waves in the transmission medium. The "transmission medium" as used here to transmit a program represents a medium having a function of transmitting information, examples of which include networks (communication networks) such as the Internet and communication lines (communication wires) such as phone lines, etc.

Also, the aforementioned program may be configured to provide a part of the aforementioned function. Also, the aforementioned program may be configured as a so-called differential file (differential program), which is to be combined with a different program stored beforehand in a computer system or computer in order to provide the aforementioned function.

Detailed description has been made with reference to the drawings regarding the embodiment according to the present invention. However, such a specific configuration is not restricted to the embodiment. Rather, various kinds of changes in design or the like may be made without departing from the scope of the present invention.

REFERENCE SIGNS

10 sewing machine
11 sewing-machine-side display unit
12 reception unit
13 sewing-machine-side storage Unit
14 control unit
15 embroidery frame identifying unit
16 sewing operation executing unit
20 tablet terminal (embroidery design connecting data generating apparatus)
21 input operation unit
22 embroidery frame information acquisition unit
23 embroidery execution number-of-times determination unit
24 embroidery design data generating unit
25 image acquisition unit
26 acquired image analyzing unit
27 embroidery design image editing unit
28 transmission unit
29 operation guidance unit
30 display unit
31 storage unit
32 display control unit
33 embroidery design data editing unit
40 embroidery frame
50 cloth
60 wireless LAN
70 USB memory.

What is claimed is:

1. An embroidery design connecting data generating apparatus comprising:

an image acquisition unit that acquires an image of an embroidery design that has been provided by sewing to a portion of a cloth;

a display unit that displays the image of the embroidery design that has been provided by sewing to the portion of the cloth after it is acquired by the image acquisition unit, and an image of an embroidery design to be sewn to the cloth, wherein the embroidery design to be sewn to the cloth is the same as the embroidery design that has been sewn to the portion of the cloth; and an embroidery design image editing unit that edits the image of the embroidery design to be sewn to the cloth, such that it is connected with the image of the embroidery design that has been provided by sewing to the portion of the cloth in a state in which they are displayed on the display unit.

2. The embroidery design connecting data generating apparatus according to claim 1, wherein the image acquisition unit acquires an image of an embroidery frame mounting the cloth, and wherein the embroidery design connecting data generating apparatus comprises:

an embroidery frame information acquisition unit that acquires information with respect to the embroidery frame; and an acquired image analyzing unit that performs image analysis so as to acquire a correspondence between the information with respect to the embroidery frame acquired by the embroidery frame information acquisition unit and information with respect to the image of the embroidery frame acquired by the image acquisition unit.

3. The embroidery design connecting data generating apparatus according to claim 2, comprising an embroidery design data generating unit that generates data of the embroidery design based on the information with respect to the embroidery frame.

4. The embroidery design connecting data generating apparatus according to claim 3, comprising an embroidery design data editing unit that edits the data of the embroidery design generated by the embroidery design data generating unit, based on the image of the embroidery design edited by the embroidery design image editing unit before it is sewn to the portion of the cloth.

5. The embroidery design connecting data generating apparatus according to claim 2, comprising an input operating unit that allows a user to input an operating instruction, wherein the embroidery design image editing unit edits the image of the embroidery design to be sewn to the cloth, according to an operating instruction received via the input operating unit.

6. The embroidery design connecting data generating apparatus according to claim 5, comprising a sewing execution number-of-times determination unit that determines a number of times that sewing of the embroidery design is to be performed for the cloth, based on the information with respect to the embroidery frame acquired by the embroidery frame information acquisition unit and information received via the input operating unit with respect to a region of the cloth to be subjected to the embroidery sewing.

7. The embroidery design connecting data generating apparatus according to claim 2, wherein the image acquisition unit performs image acquisition giving priority to a region of the cloth that is not adjacent to other regions thereof each including a portion to which the embroidery design has been sewn.

8. The embroidery design connecting data generating apparatus according to claim 7, comprising an operation guidance unit that provides a user with at least one from among a guidance display and an audio guidance in the image acquisition operation of the image acquisition unit.

9. The embroidery design connecting data generating apparatus according to claim 8, comprising a display control unit, wherein the display control unit instructs the display unit to display a reference image of the embroidery frame based on the information with respect to the embroidery frame acquired by the embroidery frame information acquisition unit, and wherein the operation guidance unit performs the guidance so as to provide an alignment between the reference image of the embroidery frame displayed on the display unit and an acquired image of the embroidery frame displayed on the display unit via the image acquisition unit.

10. The embroidery design connecting data generating apparatus according to claim 9, wherein the reference image of the embroidery frame is displayed in a semi-transparent manner on the display unit.

11. The embroidery design connecting data generating apparatus according to claim 9, wherein, when an alignment has been obtained between the reference image of the embroidery frame and the acquired image of the embroidery frame displayed on the display unit via the image acquisition unit, the image acquisition unit automatically performs image acquisition.

12. The embroidery design connecting data generating apparatus according to claim 1, wherein the embroidery design image editing unit shifts at least one from among a vertex or a side of a polygonal shape that corresponds to an outline of the image of the embroidery design to be sewn to the cloth, so as to modify the image of the embroidery design to be sewn to the cloth.

13. An embroidery design connecting data generating method employed in an embroidery design connecting data generating apparatus, the embroidery design connecting data generating method comprising:

acquiring, by an image acquisition unit included in the embroidery design connecting data generating apparatus, an image of an embroidery design that has been provided by sewing to a portion of a cloth;

displaying, by a display unit included in the embroidery design connecting data generating apparatus, the image of the embroidery design that has been provided by sewing to the portion of the cloth after it is acquired by the image acquisition unit, and an image of an embroidery design to be sewn to the cloth, wherein the embroidery design to be sewn to the cloth is the same as the embroidery design that has been sewn to the portion of the cloth; and editing, by an embroidery design image editing unit included in the embroidery design connecting data generating apparatus, the image of the embroidery design to be sewn to the cloth, such that it is connected with the image of the embroidery design that has been provided by sewing to the portion of the cloth in a state in which they are displayed on the display unit.

14. A sewing system comprising an embroidery design connecting data generating apparatus and a sewing machine, wherein the embroidery design connecting data generating apparatus comprises:

an image acquisition unit that acquires an image of an embroidery design that has been provided by sewing to a portion of a cloth;

a display unit that displays the image of the embroidery design that has been provided by sewing to the portion of the cloth after it is acquired by the image acquisition unit, and an image of an embroidery design to be sewn to the cloth, wherein the embroidery design to be sewn to the cloth is the same as the embroidery design that has been sewn to the portion of the cloth;

an embroidery design image editing unit that edits the image of the embroidery design to be sewn to the cloth, such that it is connected with the image of the embroidery design that has been provided by sewing to the portion of the cloth in a state in which they are displayed on the display unit; and a transmission unit that transmits, to the sewing machine, the image data of the embroidery design edited by the embroidery design image editing unit or otherwise embroidery design data edited based on the image of the embroidery design edited by the embroidery design image editing unit, and wherein the sewing machine comprises:

a reception unit that receives, from the transmission unit, the image data of the embroidery design or otherwise the embroidery design data; and an embroidery executing unit that executes an embroidery operation for the cloth mounted on the embroidery frame according to the image data of the embroidery design or otherwise the embroidery design data received by the reception unit.

* * * * *